United States Patent [19]

Mitzner

[11] Patent Number: 4,522,103

[45] Date of Patent: Jun. 11, 1985

[54] TRAP FOR AN UMBILICAL PLUG SEPARATED FROM A MISSILE

[75] Inventor: Erik L. Mitzner, Mountain View, Calif.

[73] Assignee: Westinghouse Electric Corp., Pittsburgh, Pa.

[21] Appl. No.: 374,677

[22] Filed: May 4, 1982

[51] Int. Cl.[3] ..... F41F 3/04

[52] U.S. Cl. ..... 89/1.811; 89/1.8

[58] Field of Search ..... 49/42, 46; 43/58, 74, 43/60, 71, 65, 66; 89/1.811, 1.813, 1.8; 293/15, 16; 244/3.1; 292/DIG. 40, DIG. 71, DIG. 5, DIG. 61; 222/251, 252, 284, 305, 425, 436

[56] References Cited

U.S. PATENT DOCUMENTS

| | | | |
|---|---|---|---|
| 349,156 | 9/1886 | Greenleaf | 49/46 |
| 417,141 | 12/1889 | Brady | 49/46 |
| 566,174 | 8/1896 | Hitchcock | 293/16 |
| 1,446,805 | 2/1923 | Martin | 293/16 |
| 1,612,480 | 12/1926 | Wells | 292/DIG. 40 |
| 2,099,456 | 11/1937 | Sweet | 292/DIG. 40 |
| 3,224,335 | 12/1965 | Witherspoon et al. | 89/1.811 |
| 3,245,319 | 4/1966 | Kossan et al. | 89/1.811 |
| 3,444,779 | 5/1969 | Buell et al. | 89/1.811 |
| 4,037,821 | 7/1977 | Green | 89/1.811 |
| 4,092,898 | 6/1978 | Witherspoon | 89/1.811 |
| 4,388,853 | 6/1983 | Griffin et al. | 89/1.811 |

*Primary Examiner*—Richard E. Schafer
*Assistant Examiner*—David Kent Cornwell
*Attorney, Agent, or Firm*—F. J. Baehr, Jr.

[57] ABSTRACT

A fly trap for capturing umbilical plugs ejected radially outwardly from a missile during the initial portion of the launch, the fly trap comprises impact and retention arms and a ratchet and compression spring which cooperate with a housing to allow the arms to only rotate a limited amount to retain the plug within the arms and prevent it from rebounding into the missile as the missile accelerates in the launch tube.

6 Claims, 6 Drawing Figures

TRAP FOR AN UMBILICAL PLUG SEPARATED FROM A MISSILE

BACKGROUND OF THE INVENTION

This invention relates to a trap for a traveling object and more particularly to a device for retaining an umbilical plug separated from a missile. In order to control and monitor a missile, it is electrically connected to a command center via an umbilical cable, which is unplugged and positively separated from the missile so that it leaves the missile with a radial velocity sufficient to clear the plug from the missile during the initial portion of the launch. A device which will catch and retain the plug is required to prevent damage to the plug and to the missile.

SUMMARY OF THE INVENTION

In general a trap for a traveling object, when made in accordance with this invention, comprises a pair of spaced-apart rotatable sleeves each sleeve having a first arm disposed in the path of the traveling object and a second arm disposed at an angle with respect to the first arm and out of the path of the traveling object. Each sleeve also has means for limiting the rotation of the sleeve and arms whereby the traveling object contacts the first arms, rotates the sleeve and arms to their limits and the first arms stop the traveling object while the second arms prevent rebound of the traveling object trapping it between the arms.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
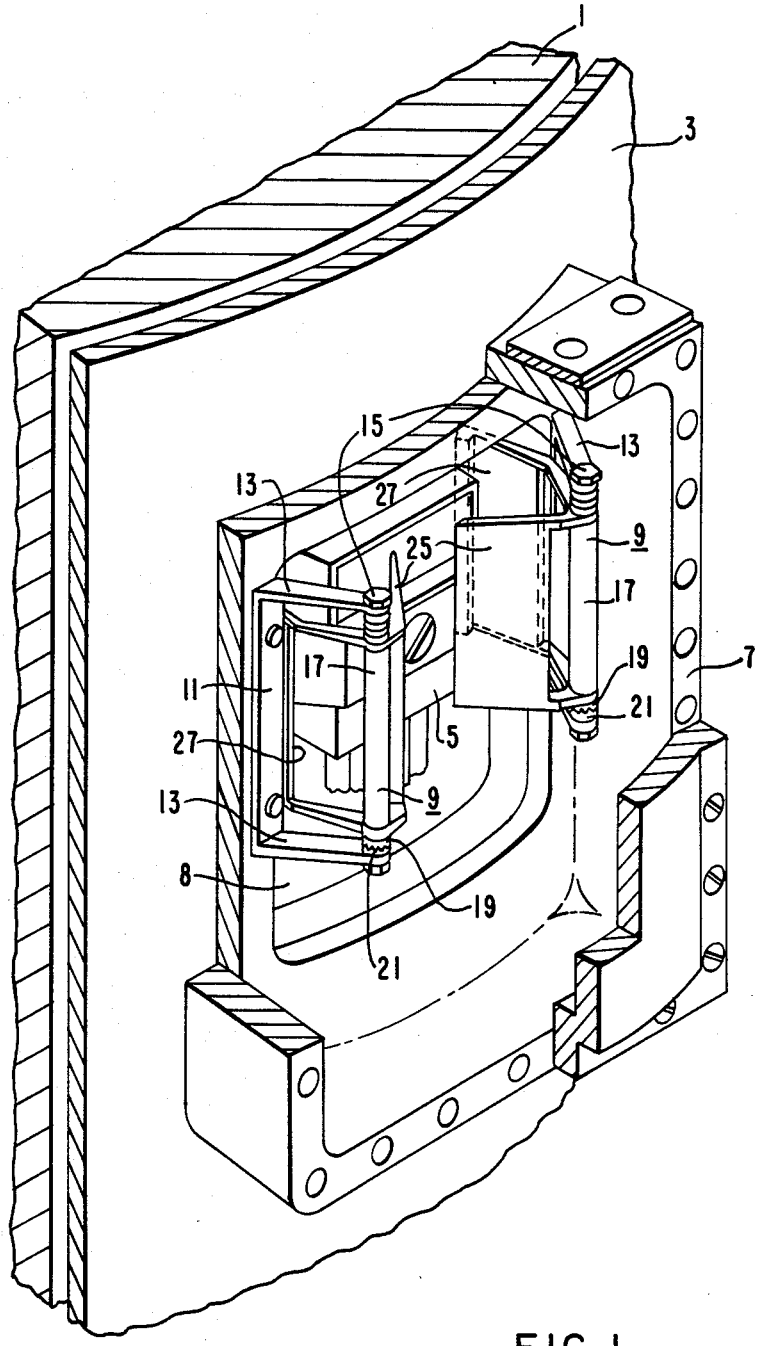
FIG. 1 is a perspective view partially in section showing a trap.
Figure 2:
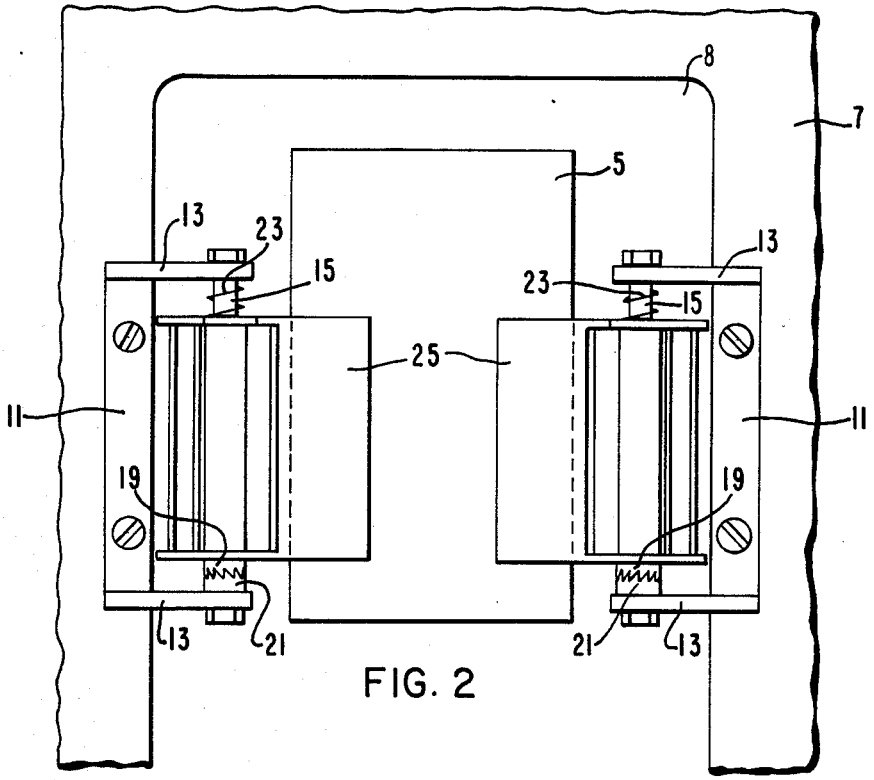
FIG. 2 is an enlarged elevational view of the trap.

Referring now to the drawings in detail and in particular to FIG. 1 there is shown a portion of a missile 1 disposed in a launch tube 3 and an umbilical plug 5 connects the missile 1 to a command center (not shown). During the initial portion of the launch the plug 5 is separated from the missile 1 by hitting the launch tube 3, which cooperates with ramps R and springs S as shown in detail in FIG. 6 to provide the plug 5 with a radially outward velocity to move the plug 5 radially into an umbilical housing 7, which encloses an opening 8 in the launch tube 3 and extends radially outwardly from the launch tube 3. A trap 9 is disposed in the umbilical housing 7. The trap 9 is adapted to receive the impact of the traveling plug 5 and to prevent the plug 5 from rebounding and bouncing back into the missile 1. The trap 9 is referred to as a fly trap as it catches and holds the flying umbilical plug 5, but could be utilized to stop and trap any flying object.

The trap 9 comprises a pair of generally U-shaped brackets 11 each having a pair of legs 13. The brackets 11 are attached to the umbilical housing 7 on opposite sides of the opening 8 so that the legs extend generally radially outwardly and toward an adjacent leg 13 on the opposing bracket 11. A shaft or pin 15 is disposed on the distal end of each pair of legs 13 and a rotatable member or sleeve 17 is rotatably disposed on each pin 15. A sawtooth ratchet 19 or other means for limiting the rotation of the sleeve 17 is disposed on the lower end of each sleeve 17, which engages a mating sawtooth ratchet 21 on the lower legs 13 of each bracket 11. A compression spring 23 fits over each pin 15 and is disposed between each upper leg 13 and the sleeve 17 to bias the sawtooth ratchets 19 and 21 into engagement. The sawtooth ratchets 19 and 21 are formed with a plurality of ramps and vertically oriented risers so disposed that the sleeve 17 can only rotate in one direction.

A plurality of first or impact arms 25 are attached to the sleeve 17 so that they extend at right angles thereto. A plurality of second arms or retention arms 27 are disposed at right angles to the sleeve 17 and form an obtuse angle with respect to the first arms 25. The impact arms 25 have a shock or impact absorbing pad 29 disposed on the distal end thereof and the distal ends of the retaining arms 27 also have pads 31 disposed thereon.

Figure 6:
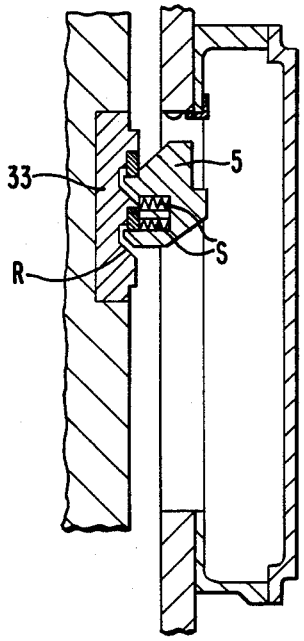
FIG. 6 is a partial section view of a plug separating arrangement used in conjunction with the trap.

FIG. 6 shows the plug 5 in a receptacle 33. The plug 5 and receptacle 33 have ramps R, which cooperate with springs S disposed in the plug 5 to impart radial acceleration to the plug 5 as the missile 1 begins to move upwardly during the launch and the plug 5 strikes the top of the opening 8 in the launch tube 3. The acceleration caused by the ramps R alone provide a sufficiently high velocity to move the plug 5 away from the missile and into the umbilical housing.

Figure 3:
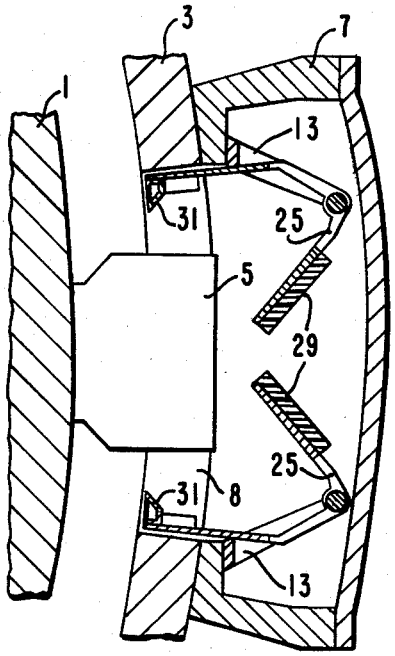
FIGS. 3, 4 and 5 are sectional views showing the operation of the trap.
Figure 4:
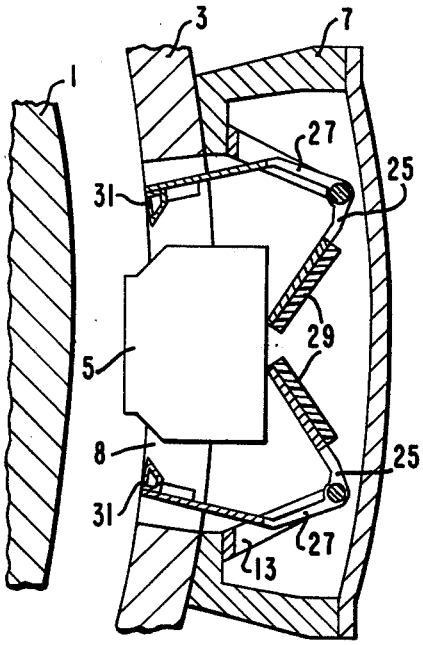
Figure 5:
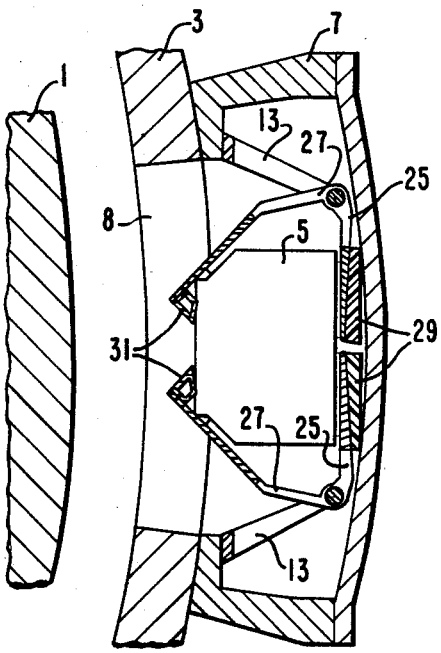

As shown progressively in FIGS. 3, 4 and 5, as the plug 5 moves radially outwardly from the missile 1 it contacts the impact arms 25, the shock absorbing pads 29 cooperate with the ratchets 19 and 21 and spring 23 and umbilical housing which acts as a stop to absorb the impact and limit the rotation of the impact arms 25. The retention arms 27 move with the impact arms 25 trapping or capturing the umbilical plug 5 within the arms 25 and 27 and prevent the plug 5 from rebounding off the impact arms 25 and striking the accelerating missile 1. The pads 31 on the retention arms 27 cooperate with the impact arms 25 to limit the movement of the plug 5 within the arms 25 and 27.

The trap 9 hereinbefore described provides a relatively small and simple mechanism which reduces the size of the umbilical plug housing 7 and the size of the openings 8 in the launch tube 3 making the trap 9 inexpensive to manufacture, install and maintain. Reducing the size in the opening 8 in the launch tube 3 reduces the stresses in the launch tube 3 and produces a smaller umbilical housing 7, which allows for smaller silos and further cost and space savings.

I claim:

1. An umbilical plug trap for trapping and retaining an umbilical plug separated from a missile said umbilical plug trap comprising:

a pair of spaced-apart brackets;

a rotatable member rotatably disposed on each bracket;

each rotatable member having affixed rigidly thereto a first arm disposed in the path of said umbilical plug and a second arm disposed at an angle with respect to the first arm and out of the path of the umbilical plug; and means for limiting the direction of rotation of said rotatable members and arms to a single direction and for limiting the extent of said rotation, whereby said umbilical plug contacts said first arms, rotates said rotatable member and arms to their limits and said first arms stop said umbilical plug and said second arms prevent rebounding of said umbilical plug, trapping and retaining it between said first and second arms.

2. An umbilical plug trap as set forth in claim 1, wherein said first arms have means for absorbing shock disposed thereon.

3. An umbilical plug trap as set forth in claim 1, wherein said second arms have means for supporting said umbilical plug.

4. An umbilical plug trap as set forth in claim 1, wherein said means for limiting the rotation of said member and arms comprises a ratchet.

5. An umbilical plug trap as set forth in claim 4, wherein said means for limiting the rotation of said member and arms comprises a spring which cooperates with said ratchet.

6. An umbilical plug trap as set forth in claim 1 wherein said first and second arms form an obtuse angle.

* * * * *